US006550262B2

(12) United States Patent
Kaneko

(10) Patent No.: US 6,550,262 B2
(45) Date of Patent: Apr. 22, 2003

(54) EXPANSION VALVE UNIT

(75) Inventor: Takeshi Kaneko, Hachioji (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 10/193,617

(22) Filed: Jul. 11, 2002

(65) Prior Publication Data

US 2003/0014989 A1 Jan. 23, 2003

(30) Foreign Application Priority Data

Jul. 19, 2001 (JP) ..... 2001-219744

(51) Int. Cl.[7] ..... F25B 41/04
(52) U.S. Cl. ..... 62/225; 236/92 B; 137/901
(58) Field of Search ..... 62/225; 236/92 B; 137/901, 539, 539.5, 540

(56) References Cited

U.S. PATENT DOCUMENTS 5,228,619 A * 7/1993 Yano et al. ..... 236/92 B
5,297,728 A * 3/1994 Yano et al. ..... 236/92 B
5,547,126 A * 8/1996 Bograd et al. ..... 236/92 B
5,826,438 A * 10/1998 Ohishi et al. ..... 236/92 B
5,957,376 A * 9/1999 Fujimoto et al. ..... 236/92 B
5,961,038 A * 10/1999 Okada ..... 236/92 B
5,996,899 A * 12/1999 Watanabe et al. ..... 236/92 B

* cited by examiner

*Primary Examiner*—William E. Tapolcai
*Assistant Examiner*—Mohammad M. Ali
(74) *Attorney, Agent, or Firm*—Patterson, Thuente, Skaar & Christensen, LLC

(57) ABSTRACT

An expansion valve unit which prevents a temperature-sensing error from occurring due to transmission of a temperature lowered by the expansion of the refrigerant to a temperature-sensing chamber. An expansion valve unit is configured such that a high-pressure refrigerant guide groove is formed circumferentially in a body between a temperature-sensing chamber and a low-pressure refrigerant passage so as to guide a high-temperature and high-pressure refrigerant from the high-pressure refrigerant guide groove to a valve hole by way of a high-pressure refrigerant passage. By providing the high-pressure refrigerant guide groove, a heat conduction area for conducting heat from the temperature-sensing chamber to the low-pressure refrigerant passage is reduced, and the high-pressure refrigerant guide groove, which is supplied with the high-temperature and high-pressure refrigerant and hence always heated to a high temperature, thermally insulates the temperature-sensing chamber from the low-pressure refrigerant passage. This prevents the temperature-sensing chamber from being adversely affected by the low temperature of the low-pressure refrigerant passage, thereby preventing occurrence of a temperature-sensing error.

15 Claims, 8 Drawing Sheets

EXPANSION VALVE UNIT

BACKGROUND OF THE INVENTION (1) Field of the Invention

This invention relates to an expansion valve unit, and more particularly to an expansion valve unit which controls the quantity of refrigerant flowing into an evaporator in a refrigeration cycle according to the temperature and pressure of refrigerant sent out from the evaporator to a compressor in the refrigeration cycle.

(2) Description of the Related Art

In an air conditioning system installed on an automotive vehicle, a refrigeration cycle is constructed in which high-temperature and high-pressure gaseous refrigerant compressed by a compressor is condensed by a radiator, and a high-pressure liquid refrigerant is adiabatically expanded by an expansion valve to obtain a low-temperature and low-pressure refrigerant, which is evaporated in an evaporator, and then returned to the compressor. The evaporator which is supplied with the low-temperature refrigerant exchanges heat with air in the compartment of the vehicle, thereby performing a cooling operation.

The expansion valve is comprised of a temperature-sensing chamber which senses temperature changes of the refrigerant in a low-temperature refrigerant passage on the outlet side of the evaporator, to have the pressure therein increased and decreased, and a valve mechanism which is actuated by the pressure increased and decreased in the temperature-sensing chamber for control of the flow rate of the refrigerant supplied to the inlet of the evaporator. The temperature-sensing chamber is connected to a temperature-sensing tube whose distal end portion is fixed to a refrigerant piping on the outlet side of the evaporator in a manner brought into intimate contact therewith, for sensing the temperature of the refrigerant at the outlet of the evaporator.

It should be noted that an expansion valve originally detects not only the temperature but also the pressure of the refrigerant at the outlet of an evaporator so that the valve mechanism may be controlled also in response to changes in the pressure. There is a demand for reducing of the manufacturing costs of such an expansion valve. To meet the demand, the expansion valve capable of sensing only the temperature of the refrigerant at the outlet of the evaporator has been developed, as described hereinabove. The expansion valve dispenses with a connecting portion for connecting a refrigerant piping on the outlet side of the evaporator to a refrigerant piping extending to the compressor, thereby reducing the manufacturing costs of the expansion valve. This configuration is based on the fact that when the refrigerant delivered from the expansion valve passes through the evaporator, its pressure loss in the evaporator is approximately constant, so that a pressure obtained by subtracting the pressure loss from the pressure of refrigerant at the outlet of the expansion valve can be regarded as the pressure of the refrigerant at the outlet of the evaporator.

Even in the temperature-sensing type expansion valve which dispenses with connection between the refrigerant piping on the outlet side of the evaporator and the refrigerant piping to the compressor, described above, it is desired to further reduce both the assembling cost and parts cost. The present applicant already proposed in Japanese Patent Application No. 2000-353672 an expansion valve configured such that a valve casing is formed by expanding a portion of piping, and an expansion valve unit comprised of a temperature-sensing chamber and a valve mechanism which provide minimum functions of the expansion valve is mounted in the valve casing, thereby reducing assembling cost and parts cost. After that, the present assignee proposed in Japanese Patent Application No. 2001-119686 an expansion valve configured to suppress flowing noises generated by expansion of the refrigerant, as an improvement over the above type of expansion valve. In the following, description will be given of an example of the construction of the expansion valve of a low noise type.

FIG. 6 is a longitudinal sectional view showing an example of the construction of the conventional expansion valve. FIG. 7 is a cross-sectional view taken on line a—a of FIG. 6.

The expansion valve is comprised of a valve casing 103 which is formed by enlarging an end portion of a low-pressure refrigerant piping 101 connected to the refrigerant inlet of an evaporator and joining integrally a high-pressure refrigerant piping 102 connected to a receiver to a side portion of the enlarged end portion by aluminum welding and an expansion valve unit 104 inserted into the valve casing 103 from an open end thereof. Although not particularly shown, the expansion valve unit 104 is fixed to the open end portion of the valve casing 103 such that the expansion valve unit 104 is inhibited from being drawn out from the valve casing 103.

The expansion valve unit 104 is comprised of a temperature-sensing chamber 105 and a valve mechanism integrally formed with the temperature-sensing chamber 105 actuated by internal pressure increased and decreased in the temperature-sensing chamber 105, for opening and closing a high-pressure refrigerant passage. The temperature-sensing chamber 105 has an inside thereof partitioned by a diaphragm 106 to fill the inside with the refrigerant gas therein, and a top thereof connected to a temperature-sensing tube 107 such that the temperature-sensing chamber 105 and the temperature-sensing tube 107 portion are communicated with each other. The temperature-sensing tube 107 has an end in contact with an outlet pipe of the evaporator, for sensing the temperature of the refrigerant at the outlet of the evaporator.

The valve mechanism of the expansion valve unit 104 has a high-pressure refrigerant passage 109 formed in a body 108 in a manner such that the passage 109 extends from a longitudinally approximately central side portion toward the center of the body 108. The expansion valve unit 104 has a low-pressure refrigerant passage 110 axially formed in a lower end portion thereof. Along the axis of the body 108, a hole serving as a valve hole is formed between the high-pressure refrigerant passage 109 and the low-pressure refrigerant passage 110, for communication between the high-pressure refrigerant passage 109 and the low-pressure refrigerant passage 110. An end of the hole on a low-pressure refrigerant passage side serves as a valve seat 111. Arranged in a manner opposed to the valve seat 111 is a spherical valve element 112 which is urged toward the valve seat 111 by a conical spring 113. The conical spring 113 has a base portion supported by an adjusting screw 114 screwed to be fitted in an inner wall of the low-pressure refrigerant passage 110. The adjusting screw 114 is used for adjusting a set value allowing the valve element 112 to start to be opened.

A shaft 115 is axially movably inserted along the axis of the body 108 at a location below the temperature-sensing chamber 105. The shaft 115 has one end thereof brought into abutment with or welded to the valve element 112, and the other end thereof brought into abutment with a lower surface of the diaphragm 106 via a disc 116. The shaft 115 has an upper end portion thereof positioned on the axis of the body 108 by a holder 117.

Further, the body 108 has a communication passage 118 formed therein for equalizing the pressure in a space below the diaphragm 106 of the temperature-sensing chamber 105 with the pressure in the low-pressure refrigerant passage 110. The space below the diaphragm 106 is sealed from the high-pressure refrigerant passage 109 by an O ring 119 arranged on the shaft 115.

In the expansion valve constructed as above, when refrigerant is supplied from the high-pressure refrigerant piping 102, the refrigerant passes through a gap formed between the valve seat 111 and the valve element 112, thereby undergoing adiabatic expansion, and is delivered through the low-pressure refrigerant passage 110 to the evaporator by way of the low-pressure refrigerant piping 101. On the other hand, the temperature of the refrigerant delivered from the evaporator is detected by the end portion of the temperature-sensing tube 107, and the pressure of the gas filled in the airtight chamber is increased or decreased depending on the detected temperature. The pressure in the airtight chamber displaces the plane of the diaphragm 106, and actuates the valve element 112 via the shaft 115, thereby controlling the flow rate of the refrigerant.

In the conventional expansion valve unit, refrigerant guided into the high-pressure refrigerant passage passes between the valve seat and the valve element to thereby undergo the expansion, and flows into the low-pressure refrigerant passage. At this time, the refrigerant has its temperature lowered due to expansion thereof. However, due to the lowered temperature of the low-pressure refrigerant passage, the temperature of the temperature-sensing chamber is transmitted to the low-pressure refrigerant passage via the body, whereby the diaphragm and component parts therearound become low in temperature. If the thus lowered temperature of the diaphragm and component parts therearound becomes lower than that of a temperature-sensing portion at the end of the temperature-sensing tube, the expansion valve unit senses the lowered temperature of the diaphragm and component parts therearound to start control operation, thereby causing a temperature-sensing error in the expansion valve unit, which inhibits the expansion valve unit from being properly controlled.

SUMMARY OF THE INVENTION

The present invention has been made in view of the above points, and an object thereof is to provide an expansion valve unit which prevents a temperature-sensing error from occurring due to transmit of a temperature lowered by the expansion of the refrigerant to a temperature-sensing chamber.

To achieve the above object, there is provided an expansion valve unit including a temperature-sensing chamber for sensing a temperature of a refrigerant at an outlet of an evaporator to have a pressure therein increased and decreased, a high-pressure refrigerant passage formed in a side portion of a body, a low-pressure refrigerant passage formed in an end portion of the body on an opposite side of the temperature-sensing chamber, a valve seat located at an end surface on the low-pressure refrigerant passage side of a valve hole that communicates between the high-pressure refrigerant passage and the low-pressure refrigerant passage, a valve element capable of moving to and away from the valve seat, a spring for urging the valve element in a valve-closing direction, and a shaft for transmitting displacement of the temperature-sensing chamber caused by the increased and decreased pressure therein to the valve element, the expansion valve unit being characterized by a high-pressure refrigerant guide groove which is formed circumferentially in the body between the temperature-sensing chamber and the low-pressure refrigerant passage such that the high-pressure refrigerant guide groove communicates with the high-pressure refrigerant passage, whereby the temperature-sensing chamber is thermally insulated from the low-pressure refrigerant passage.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will now be described in detail with reference to drawings.

Figure 1:
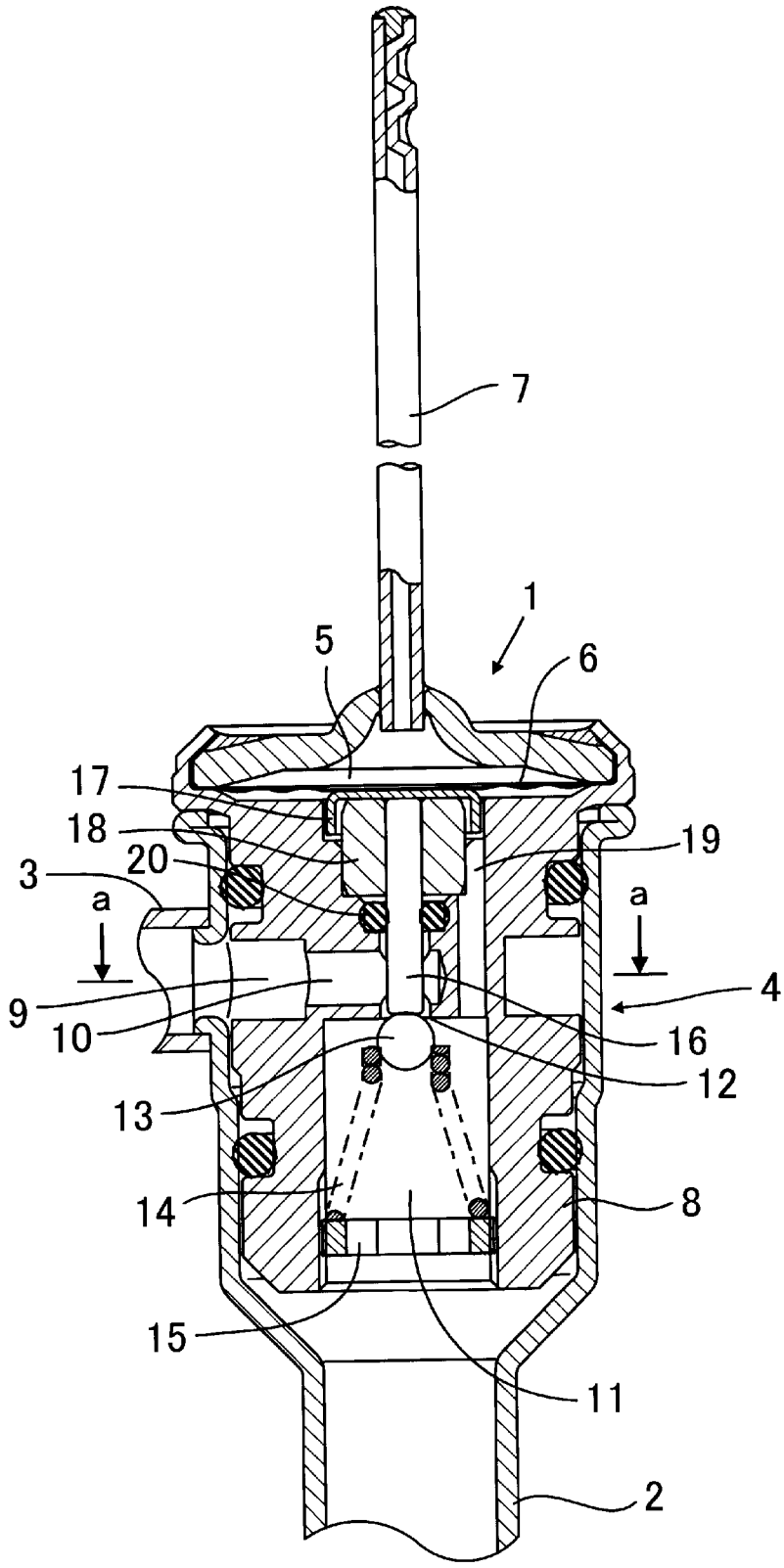
FIG. 1 is a longitudinal sectional view showing an example of the construction of an expansion valve to which is applied an expansion valve unit according to a first embodiment of the invention.
Figure 2:
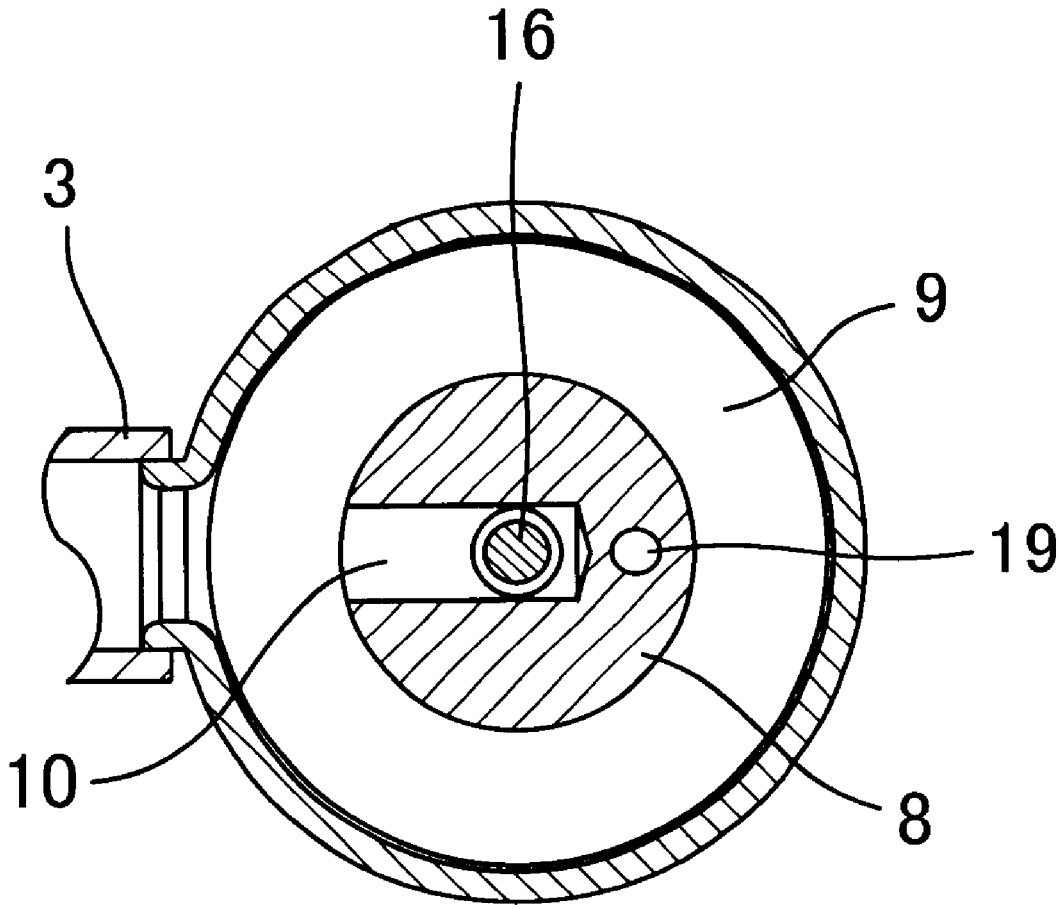
FIG. 2 is a cross-sectional view taken on line a—a of FIG. 1.

FIG. 1 is a longitudinal sectional view showing an example of the construction of an expansion valve to which is applied an expansion valve unit according to a first embodiment of the invention. FIG. 2 is a cross-sectional view taken on line a—a of FIG. 1.

The expansion valve to which is applied the expansion valve unit according to the first embodiment of the present invention is formed by inserting the expansion valve unit 1 into an upper open end of a valve casing 4 which is formed by enlarging an end portion of a low-pressure refrigerant piping 2 connected to the refrigerant inlet of an evaporator and joining integrally a high-pressure refrigerant piping 3 connected to a receiver to a side portion of the enlarged end portion by aluminum welding.

The expansion valve unit 1 is comprised of a temperature-sensing chamber 5 and a valve mechanism integrally formed with the temperature-sensing chamber 5 actuated by internal pressure increased and decreased in the temperature-sensing chamber 5, for opening and closing a high-pressure refrigerant passage. The temperature-sensing chamber 5 has an inside thereof partitioned by a diaphragm 6 to fill the inside with the refrigerant gas, and a top thereof connected to a temperature-sensing tube 7 such that the temperature-sensing chamber 5 and the temperature-sensing tube 7 are communicated with each other. The temperature-sensing tube 7 has an end portion in contact with an outlet pipe of the evaporator, for sensing the temperature of the refrigerant at the outlet of the evaporator.

The valve mechanism of the expansion valve unit 1 has a high-pressure refrigerant guide groove 9 formed circumferentially in a longitudinally approximately central portion of a body 8 and further has a high-pressure refrigerant passage 10 formed therein which extends from the high-pressure refrigerant guide groove 9 to the center on the axis of the body 8. The expansion valve unit 1 has a low-pressure refrigerant passage 11 axially formed in a lower end portion thereof. Along the axis of the body 8 a hole serving as a valve hole is formed between the high-pressure refrigerant passage 10 and the low-pressure refrigerant passage 11, for communicating between the high-pressure refrigerant passage 10 and the low-pressure refrigerant passage 11. An end of the hole on a low-pressure refrigerant passage side serves as a valve seat 12. Arranged in a manner opposed to the valve seat 12 is a spherical valve element 13 which is urged toward the valve seat 12 by a conical spring 14. The conical spring 14 has a base portion supported by an adjusting screw 15 screwed to be fitted in an inner wall of the low-pressure refrigerant passage 11. The adjusting screw 15 is used for adjusting a set value for allowing the valve element 13 to start to be opened.

A shaft 16 is axially movably inserted along the axis of the body 8 at a location below the temperature-sensing chamber 5. The shaft 16 has one end thereof brought into abutment with or welded to the valve element 13, and the other end thereof brought into abutment with a lower surface of the diaphragm 6 via a disc 17. The shaft 16 has an upper end portion thereof positioned on the axis of the body 8 by a holder 18.

Further, the body 8 has a communication passage 19 formed therein for equalizing the pressure in a space below the diaphragm 6 of the temperature-sensing chamber 5 with pressure in the low-pressure refrigerant passage 11. The space below the diaphragm 6 is sealed from the high-pressure refrigerant passage 10 by an O ring 20 arranged on the shaft 16.

In the expansion valve constructed as above, when refrigerant is supplied from the high-pressure refrigerant piping 3, the high-pressure refrigerant guide groove 9 formed circumferentially in the body 8 is filled with the high-temperature and high-pressure refrigerant. This refrigerant is guided into the high-pressure refrigerant passage 10, adiabatically expanded when passing through a gap formed between the valve seat 12 and the valve element 13, and delivered through the low-pressure refrigerant passage 11 to the evaporator by way of the low-pressure refrigerant piping 2. At this time, the temperature of the low-pressure refrigerant passage 11 is lowered by the adiabatic expansion of the refrigerant. On the other hand, the high-pressure refrigerant guide groove 9 is held in a heated state since it is always filled with the high-temperature refrigerant. Therefore, the high-pressure refrigerant guide groove 9 thermally insulates the temperature-sensing chamber 5 from the low-temperature and low-pressure refrigerant passage 11, thereby inhibiting the heat of the temperature-sensing chamber 5 from being conducted to the low-pressure refrigerant passage 11 via the central portion of the body 8 inward of the high-pressure refrigerant guide groove 9. This makes it possible to prevent the temperature-sensing chamber 5 from developing a temperature-sensing error due to a lowered temperature of the temperature-sensing chamber 5.

Next, the temperature of the refrigerant delivered from the evaporator is detected by the end portion of the temperature-sensing tube 7, and the pressure of the gas filled in the airtight chamber is increased or decreased depending on the detected temperature. The pressure in the airtight chamber displaces the plane of diaphragm 6, and actuates the valve element 13 via the shaft 16, thereby controlling the flow rate of refrigerant.

Figure 3:
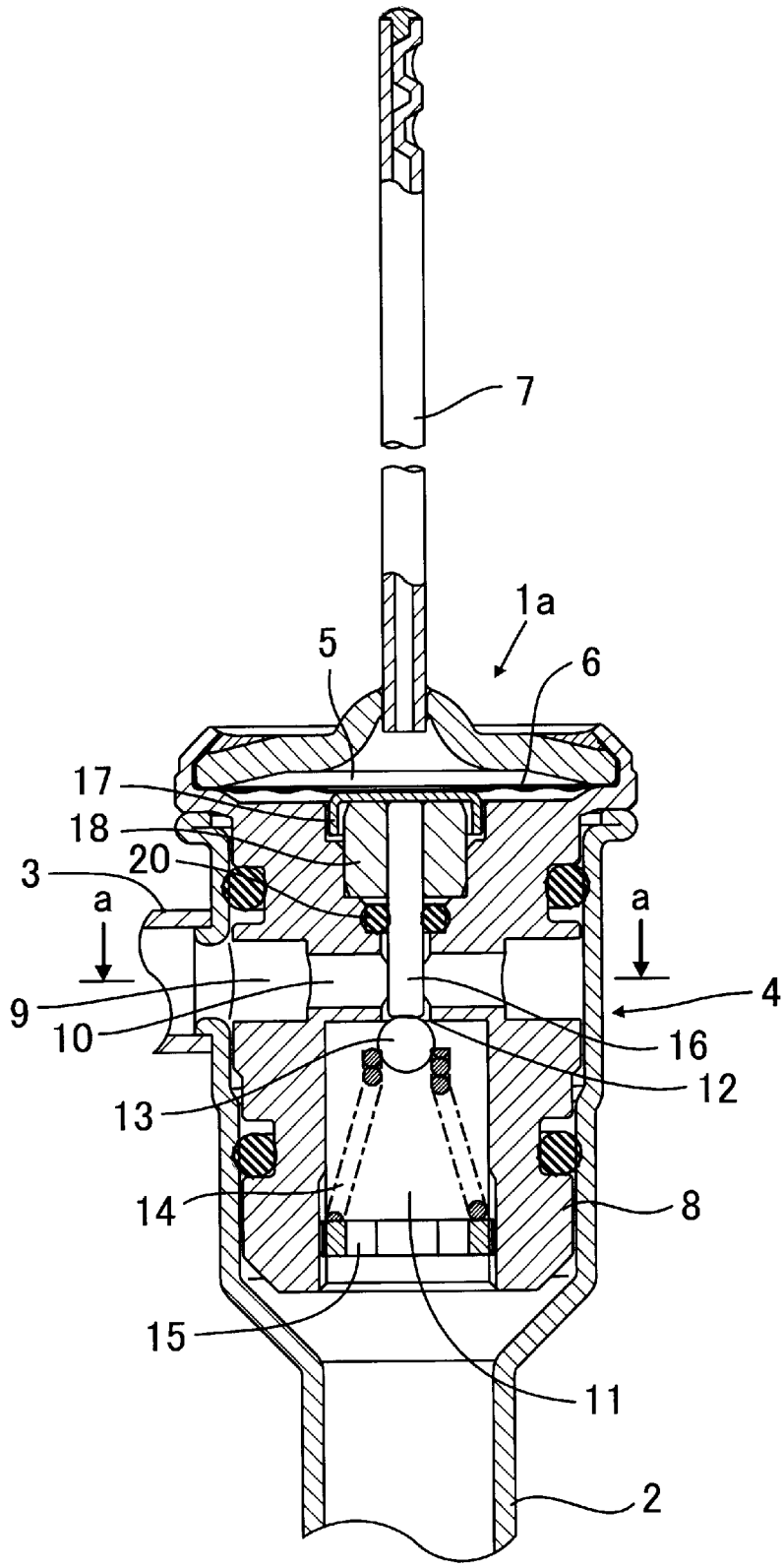
FIG. 3 is a longitudinal sectional view showing an example of the construction of an expansion valve to which is applied an expansion valve unit according to a second embodiment of the invention.
Figure 4:
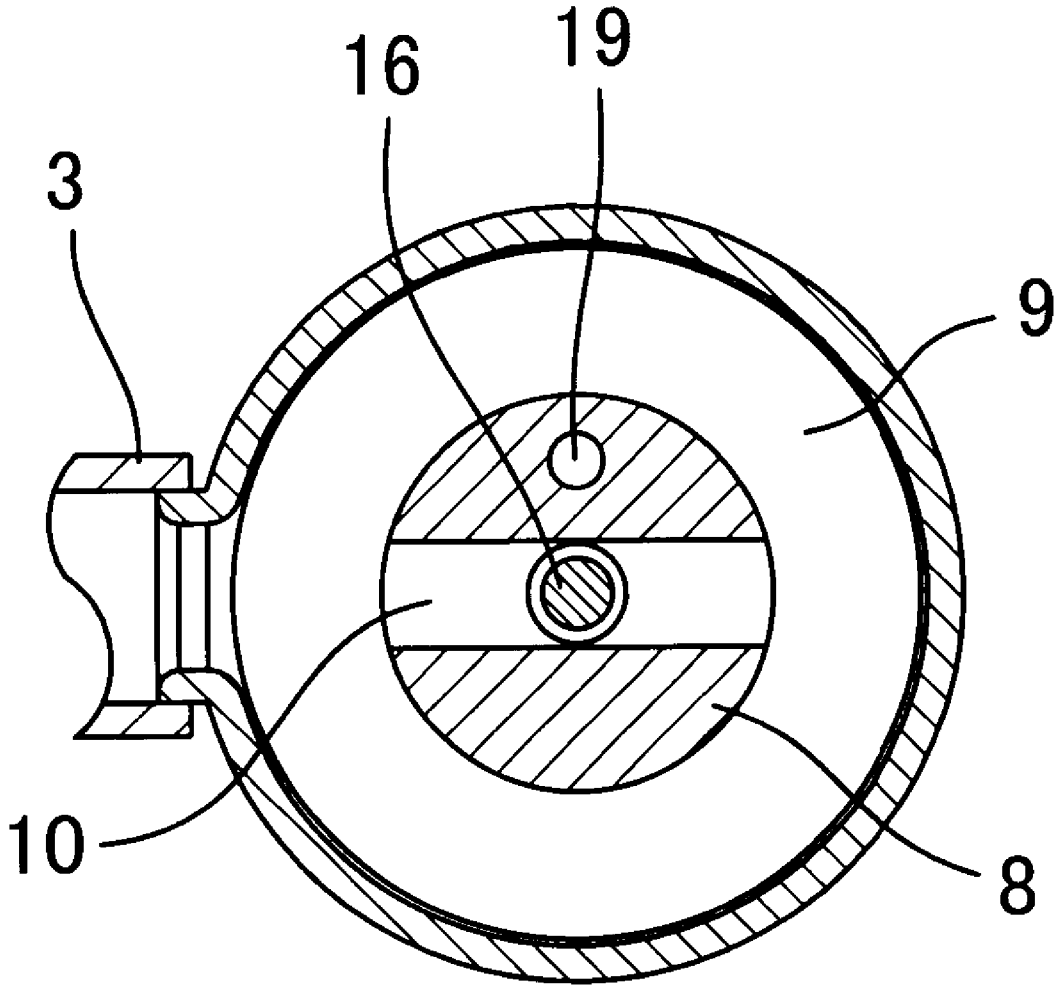
FIG. 4 is a cross-sectional view taken on line a—a of FIG. 3.

FIG. 3 is a longitudinal sectional view showing an example of the construction of an expansion valve to which is applied an expansion valve unit according to a second embodiment of the invention. FIG. 4 is a cross-sectional view taken on line a—a of FIG. 3. In FIGS. 3 and 4, component parts and elements similar or equivalent to those of the expansion valve shown in FIGS. 1 and 2 are designated by identical reference numerals, and detailed description thereof is omitted.

The expansion valve unit 1*a* according to the second embodiment has the high-pressure refrigerant passage 10 formed therein in a manner such that the high-pressure refrigerant passage 10 extends through the body 8, from the high-pressure refrigerant guide groove 9 formed circumferentially in a longitudinally approximately central portion of the body 8, across the axis in the center of the body 8. In this embodiment, the communication passage 19, which equalizes the pressure in a space below the diaphragm 6 of the temperature-sensing chamber 5 with the pressure in the low-pressure refrigerant passage 11, is arranged in a portion of the body 8 where the high-pressure refrigerant passage 10 does not extend.

This expansion valve unit 1*a* as well is configured such that the high-pressure refrigerant guide groove 9 thermally insulates the temperature-sensing chamber 5 from the low-temperature and low-pressure refrigerant passage 11. Therefore, the heat of the temperature-sensing chamber 5 is inhibited from being conducted to the low-pressure refrigerant passage 11 via the body 8. Hence, it is possible to prevent the temperature of the temperature-sensing chamber 5 from becoming lower, thereby preventing the temperature-sensing chamber 5 from developing a temperature-sensing error.

Figure 5:
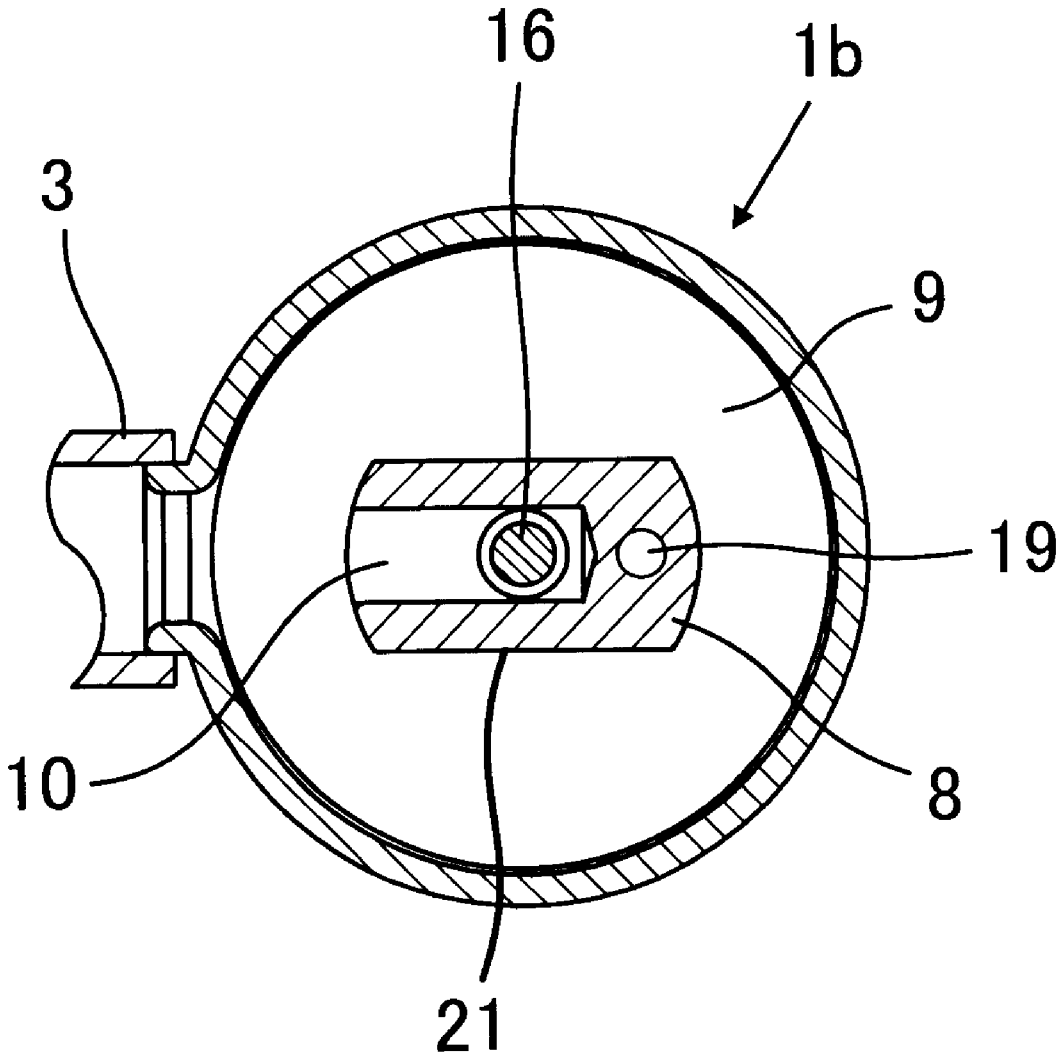
FIG. 5 is a transverse sectional view showing the construction of an expansion valve to which is applied an expansion valve unit according to a third embodiment of the invention.

FIG. 5 is a transverse sectional view showing the construction of an expansion valve to which is applied an expansion valve unit according to a third embodiment of the invention. In FIG. 5, component parts and elements similar or equivalent to those of the expansion valve shown in FIGS. 1 and 2 are designated by identical reference numerals, and detailed description thereof is omitted.

Figure 5A:
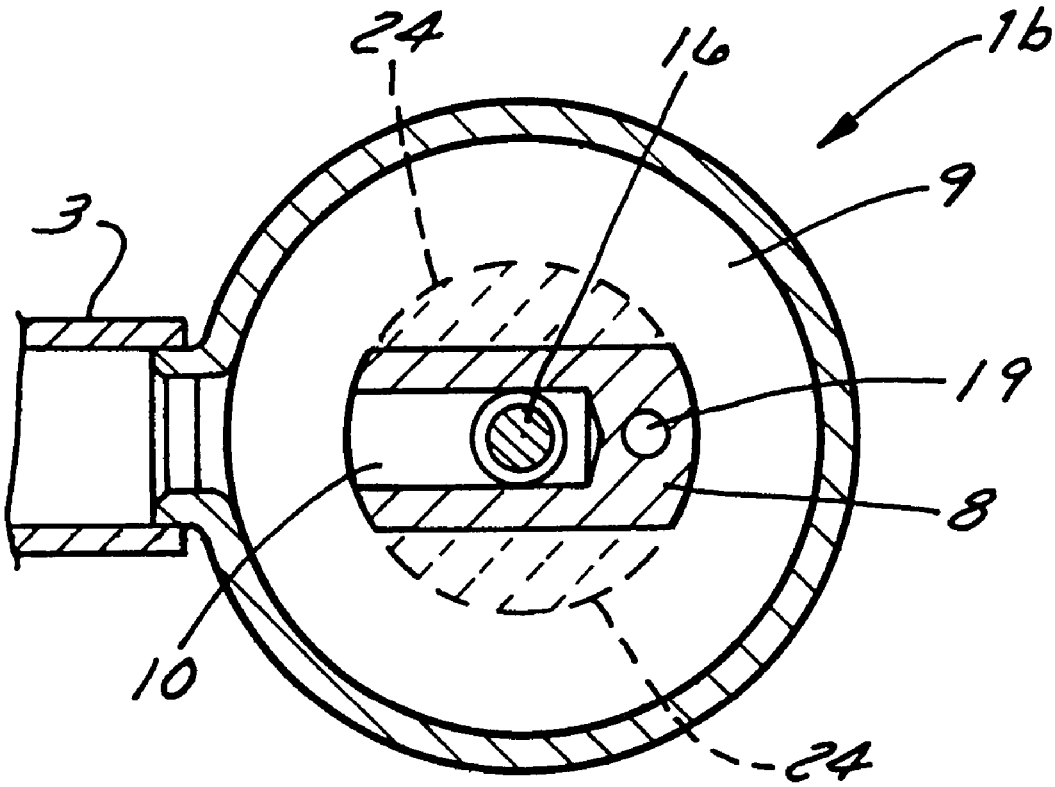
FIG. 5A is a further transverse sectional view depicting the third embodiment of the invention, further illustrating a modification from the first embodiment.
Figure 6:
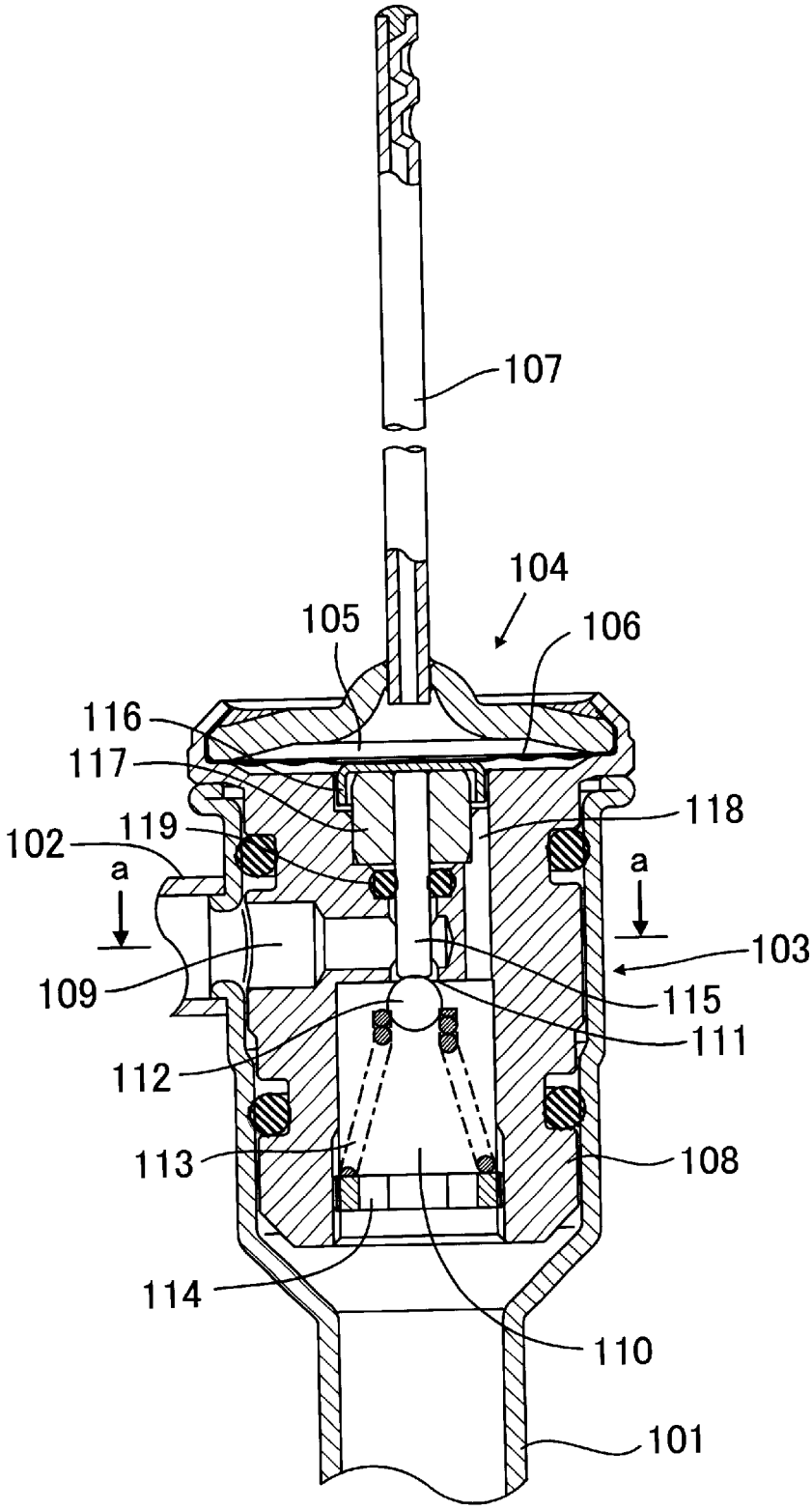
FIG. 6 PRIOR ART
FIG. 6 is a longitudinal sectional view showing an example of the construction of a conventional expansion valve.
Figure 7:
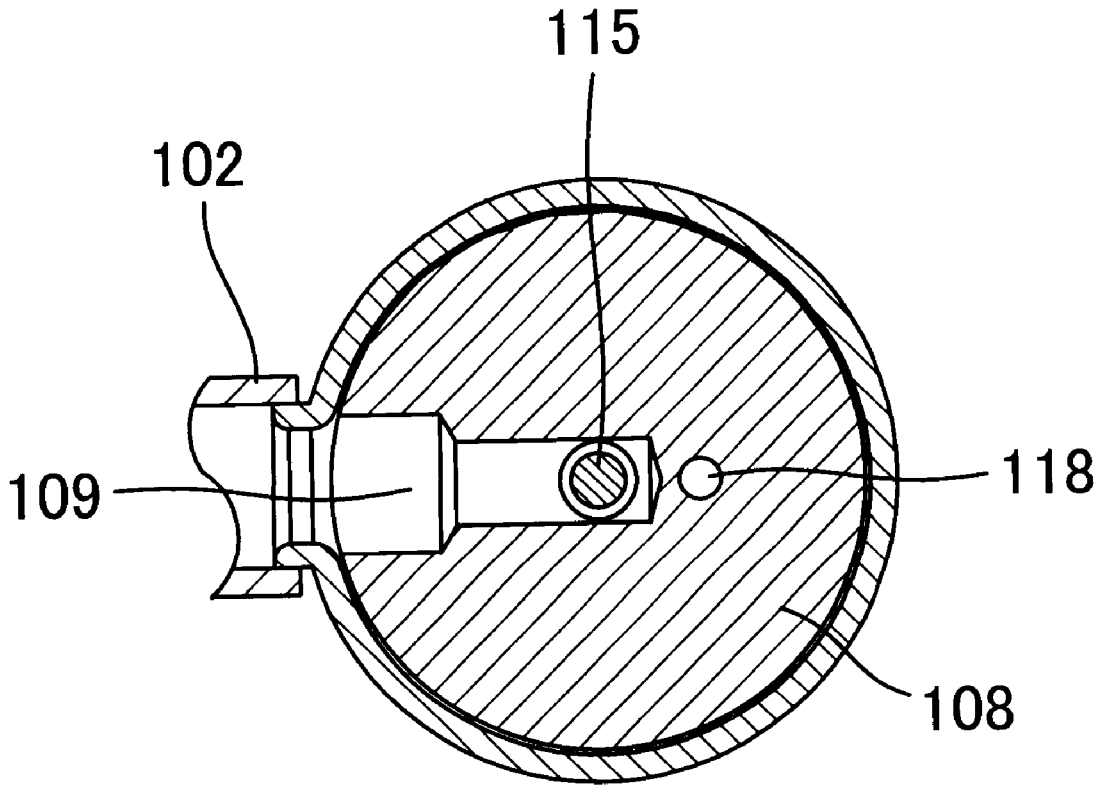
FIG. 7 PRIOR ART
FIG. 7 is a cross-sectional view taken on line a—a of FIG. 6.

The expansion valve unit 1*b* according to the third embodiment has a still smaller heat conduction area of a portion of the body 8 where the high-pressure refrigerant guide groove 9 is circumferentially formed, compared with the expansion valve unit 1 according to the first embodiment. More specifically, referring to FIG. 5A, volume of the body 8 is reduced, and volume of the guide groove 9 is increased by cutting away D-shaped portions 24 of the body 8 at locations defining the inner periphery of the high-pressure refrigerant guide groove 9. The body 8 is then left with an edge portion 21 as depicted in FIG. 5. This makes it possible to reduce the area of a heat conduction portion between the temperature-sensing chamber 5 and the low-pressure refrigerant passage 11, thereby making it difficult for heat to be conducted from the temperature-sensing chamber 5 to the low-pressure refrigerant passage 11.

As described heretofore, according to the invention, the high-pressure refrigerant guide groove is formed circumferentially in the body between the temperature-sensing chamber and the low-pressure refrigerant passage such that the refrigerant is guided from the high-pressure refrigerant guide groove to the valve hole by way of the high-pressure refrigerant passage. As a result, a heat conduction area that conducts heat from the temperature-sensing chamber to the low-pressure refrigerant passage is reduced, and the high-pressure refrigerant guide groove has the function of thermally insulating the temperature-sensing chamber from the low-pressure refrigerant passage. This makes it possible to prevent the temperature-sensing chamber from developing a temperature-sensing error due to the lowered temperature thereof caused by heat conduction from the temperature-sensing chamber to the low-pressure refrigerant passage.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An expansion valve unit including a temperature-sensing chamber for sensing a temperature of a refrigerant at an outlet of an evaporator to have a pressure therein increased and decreased, a high-pressure refrigerant passage formed in a side portion of a body, a low-pressure refrigerant passage formed in an end portion of the body on an opposite side of the temperature-sensing chamber, a valve seat located at an end surface on a low-pressure refrigerant passage side of a valve hole that communicates between the high-pressure refrigerant passage and the low-pressure refrigerant passage, a valve element capable of moving to and away from the valve seat, a spring for urging the valve element in a valve-closing direction, and a shaft for transmitting displacement of the temperature-sensing chamber caused by the increased and decreased pressure therein to the valve element, the expansion valve unit being characterized by a high-pressure refrigerant guide groove which is formed circumferentially in the body between the temperature-sensing chamber and the low-pressure refrigerant passage such that the high-pressure refrigerant guide groove communicates with the high-pressure refrigerant passage, whereby the temperature-sensing chamber is thermally insulated from the low-pressure refrigerant passage.

2. The expansion valve unit according to claim 1, wherein the high-pressure refrigerant passage is formed such that the high-pressure refrigerant passage extends through a portion of the body inward of the high-pressure refrigerant guide groove.

3. The expansion valve unit according to claim 1, wherein the portion of the body inward of the high-pressure refrigerant guide groove is inwardly cut to remove D-shaped portions to reduce a heat conduction area of the portion of the body.

4. The expansion valve unit of claim 1, wherein said high-pressure refrigerant passage communicates with said guide groove at more than one location within said body.

5. The expansion valve unit of claim 1, wherein said guide groove is further defined by the absence of D-shaped portions of said body.

6. An expansion valve unit comprising:

a casing;

a temperature-sensing chamber;

a substantially cylindrical body;

a high-pressure refrigerant passage within said body, formed in a radial direction;

a low-pressure refrigerant passage within said body formed in an axial direction;

an expansion valve allowing communication between said high-pressure refrigerant passage and said low-pressure refrigerant passage;

a spring to bias said expansion valve in a closed position;

a shaft for transmitting a displacement of said temperature-sensing chamber to said expansion valve, thereby controlling operation of said valve; and a reservoir within said body;

wherein said reservoir communicates with said high-pressure refrigerant passage, and whereby said reservoir thermally insulates said temperature-sensing chamber from said low-pressure refrigerant passage.

7. The expansion valve unit of claim 6, wherein said reservoir is located in the body between said temperature-sensing chamber and said low-pressure refrigerant passage.

8. The expansion valve unit of claim 7, wherein said high-pressure refrigerant passage communicates with said reservoir at more than one location within said body.

9. The expansion valve unit of claim 7, wherein said reservoir is formed circumferentially within said body.

10. The expansion valve unit of claim 8, wherein said reservoir is further defined by the absence of D-shaped portions of said body.

11. An expansion valve unit comprising:

a temperature-sensing chamber;

a substantially cylindrical body;

a high-pressure refrigerant passage within said body, formed in a radial direction;

a low-pressure refrigerant passage within said body formed in an axial direction;

an expansion valve allowing communication between said high-pressure refrigerant passage and said low-pressure refrigerant passage;

a spring to bias said expansion valve in a closed position;

a shaft for transmitting a displacement of said temperature-sensing chamber to said expansion valve, thereby controlling operation of said expansion valve; and an insulating chamber formed within said body and in communication with said high-pressure refrigerant passage;

wherein said insulating chamber thermally insulates said temperature-sensing chamber from said low-pressure refrigerant passage.

12. The expansion valve unit of claim 11, wherein said insulating chamber is located in the body between said temperature-sensing chamber and said low-pressure refrigerant passage.

13. The expansion valve unit of claim 12, wherein said high-pressure refrigerant passage communicates with said reservoir at more than one location within said body.

14. The expansion valve unit of claim 12, wherein said insulating chamber is formed circumferentially within said body.

15. The expansion valve unit of claim 14, wherein said insulating chamber is further defined by the absence of D-shaped portions of said body.

* * * * *